US010968037B2

(12) United States Patent
Schinasi

(10) Patent No.: US 10,968,037 B2
(45) Date of Patent: Apr. 6, 2021

(54) STACKABLE BAG FOR THE TRANSPORT AND STORAGE OF BULK GOODS

(71) Applicant: Codefine International SA, Lausanne (CH)

(72) Inventor: Piero Schinasi, Epalinges (CH)

(73) Assignee: Codefine International SA, Lausanne (CH)

( * ) Notice: Subject to any disclaimer, the term of this patent is extended or adjusted under 35 U.S.C. 154(b) by 0 days.

(21) Appl. No.: 16/483,673

(22) PCT Filed: Sep. 29, 2017

(86) PCT No.: PCT/IB2017/056025

§ 371 (c)(1),
(2) Date: Aug. 5, 2019

(87) PCT Pub. No.: WO2018/142196

PCT Pub. Date: Aug. 9, 2018

(65) Prior Publication Data

US 2019/0367264 A1 Dec. 5, 2019

(30) Foreign Application Priority Data

Feb. 6, 2017 (EP) ..... 17154827

(51) Int. Cl.
*B65D 88/16* (2006.01)

(52) U.S. Cl.
CPC ..... *B65D 88/1687* (2013.01)

(58) Field of Classification Search
CPC ..... B65D 88/1687; B65D 88/1681
USPC ..... 383/24
See application file for complete search history.

(56) References Cited

FOREIGN PATENT DOCUMENTS

| | | | | |
|---|---|---|---|---|
| CH | 698245 | B1 | 6/2009 | |
| DE | 202005006012 | U1 | 8/2005 | |
| EP | 1023232 | B1 | 8/2000 | |
| WO | WO-9854070 | A1 * | 12/1998 | ..... B65D 88/1687 |

(Continued)

OTHER PUBLICATIONS

Machine traslation of WO-9854070-A1.*

(Continued)

*Primary Examiner* — Jes F Pascua
(74) *Attorney, Agent, or Firm* — Taft Stettinius & Hollister LLP

(57) ABSTRACT

A bag for the transport and storage of bulk goods including: at least a bottom, four sides connected along adjacent edges to form vertical ridges at each of the four corners of the bag and each side connected to a lid along an upper edge to form a horizontal ridge; four lifting straps each having a first and second sections separated by an intermediate section and sewn on a vertical ridge of the bag, and with the intermediate section forming an oblong loop and positioned along the horizontal ridge of the bag; and four restraining straps each having two vertical sections separated by a U-shaped section, and with each vertical section sewn on one side of the bag and the U-shaped section positioned over the intermediate section of a lifting strap and at least partially sewn thereon, and wherein the restraining straps are configured to limit extension of the top of the loops formed by the intermediate sections of the lifting straps in the vertical direction.

8 Claims, 3 Drawing Sheets

(56) References Cited

FOREIGN PATENT DOCUMENTS

WO 2013079345 A1 6/2013

OTHER PUBLICATIONS

International Search Report; European Patent Office; International Application No. PCT/IB2017/056025; dated Nov. 22, 2017; 4 pages.
Written Opinion of the International Searching Authority; European Patent Office; International Application No. PCT/IB2017/056025; dated Nov. 22, 2017; 6 pages.

* cited by examiner

STACKABLE BAG FOR THE TRANSPORT AND STORAGE OF BULK GOODS

CROSS REFERENCE TO RELATED APPLICATIONS

This application is a U.S. national stage filing of International Patent Application No. PCT/IB2017/056025 filed Sep. 29, 2017, which claims priority to European Application No. 17154827.4 filed Feb. 6, 2017, the contents of each application hereby incorporated by reference in their entirety.

TECHNICAL FIELD

The present invention relates to a stackable bag for the transport and storage of bulk goods.

STATE OF THE ART

Bags for the transport and storage of bulk goods, which are also known as "big bags", serve for the transportation, handling and storage of the most diverse goods. They are well known from port, railway and road sites in particular.

To give an idea, but without limiting the field of the invention, it can be noted that the bags of this type have usual dimensions ranging from a cube with sides of 60 cm to a parallelepiped with a length of 125 cm, a width of 125 cm and a height of 220 cm. All intermediate variants can find a use according to the good to be transported and its particularities.

These bags are produced from synthetic cloth in general and are provided with straps intended to hold them in position during filling. These straps also serve for handling the bags. In addition, the bags of this type are very often provided with filling ducts located on their top face, when they have one. The lifting straps make it possible not only to hold the bag on a filling installation, but also to move it, in particular by means of a crane.

Though the said straps are also suited to filling installations, which are in fact equipped accordingly, they are less well suited to handling. This is because it is found that the handling areas are equipped with more and more fork-lift trucks and fewer and fewer cranes. One of the reasons for this change is the more and more extensive use firstly of containers and secondly of pallets, pallets often going together with containers.

The bags are thus frequently disposed on pallets in order to manoeuvre and transport them, in particular in order to introduce them into containers, the tops of which prevent the use of a crane.

Though the use of pallets allows a facilitated handling of bags by fork-lift trucks, it has a major drawback: the load in the containers is not optimal and space is substantially lost.

The document EP 1 023 232 B1 proposes a bag permitting to solve this problem. Indeed, the proposed bag has lifting straps fixed in pairs in two groups along the vertical edges of the bag, the lifting straps being adapted to receive the forks of a fork-lift truck. However, when such a bag is raised by the fork lift, the lifting straps project substantially above the plane of the top surface of the bag, so that it is difficult to stack two bags one on top of the other if said bags are completely filled, the height of the container being insufficient for the handling of the raised bag and space is lost in the container on the side and the top of the bag. Further, when the sleeves are disposed on the side of the bag more space is also necessary. Therefore, to permit the handling of the upper row bags, it is necessary that the lower row bags are not filled at their maximum height. This leads to a waste of space in the containers. Therefore, this solution is not economically attractive for a great number of bags to transport. Furthermore, in this bag, the lifting straps are obliquely oriented relative to the top surface of the bag when the bag is raised, thus shaping the top of the bag as a cone. This leads to a waste of space in the bag, and thus also in the container.

The aim of the present invention is to propose a bag avoiding the above-mentioned problems.

DISCLOSURE OF THE INVENTION

The invention concerns a bag for transporting and storing bulk goods comprising lifting straps, comprising at least a bottom and four sides, wherein the four sides are connected along adjacent edges to form vertical ridges at each of the four corners of the bag and each side is connected to a lid along an upper edge to form a horizontal ridge;

wherein the bag further comprises four lifting straps, each lifting strap having a first section and a second section separated by an intermediate section;

wherein the first and the second sections are sewn on a vertical ridge of the bag;

wherein the intermediate section forms an oblong loop and is positioned along the horizontal ridge of the bag;

wherein the bag further comprises four restraining straps, each restraining strap having two vertical sections separated by a U-shaped section, each vertical section being sewn on one side of the bag and the U-shaped section being positioned over the intermediate section of a lifting strap and being at least partially sewn thereon;

wherein the restraining straps are configured so as to limit the extension of the top of the loops formed by the intermediate sections of the lifting in the vertical direction.

The restraining straps are configured so as to prevent that the top of the loops formed by the intermediate sections of the lifting straps project more than 15 cm above the top head of the bag.

The lifting straps are interconnected in pairs by link means forming respective tubes or ducts, the link means being constituted by pieces of fabric stitched onto the lifting straps and matching the outlines of the lifting straps over at least a portion thereof.

The said pieces of fabric may be chosen from a fabric with a weight per square metre greater than 70 grams.

Thus configured, the bag of the present invention avoids that the lifting straps substantially project above the top surface of the bag when the bag is raised by the forks of a fork-lift truck. Therefore, two bags fully filled can be stacked on top of each other in a container, thus limiting the waste of space. Furthermore, the lifting straps are substantially maintained in the same orientation by the restraining straps so that they are not obliquely oriented relative to the lid when the forks of the fork-lift truck raise the bag.

BRIEF DESCRIPTION OF THE DRAWINGS

The following description is provided by way of non-limiting example. It relates to the drawing, in which;

FIG. 1 shows the bag 10 which is illustrated here in a substantially cubic shape which is not a limitation. The bag 10 comprises a bottom 19, four sides 11-14 and a lid 17. The four sides 11-14 are connected along their adjacent edges to form vertical ridges 15 at each of the four corners of the bag and each side 11-14 is connected to the lid 17 along an upper edge to form a horizontal ridge 16. The lid 17 defines a substantially planar surface and is provided with a filling duct 18. It is to be noted that the presence of a lid 17 and a filling duct 18 is optional. In a variant, the top head of the bag remains open. Lifting straps 20 are sewn at each corner of the bag. The lifting straps 20 are interconnected in pairs by link means forming respective tubes or ducts 22, the tubes or ducts 22 being constituted by pieces of fabrics stitched onto the lifting straps 20 and matching the outlines of the straps over at least a portion thereof. The tubes or ducts are thus created in the purpose of allowing the engagement of the arms of the fork of the fork-lift truck in these tubes or ducts. The material used for forming the tubes or ducts should be preferably fairly strong, to offer sufficient relative rigidity and strength, having regard to the role which it has to play. By way of example and without wishing to limit in any way the scope of the invention, it can be noted that a preferred material is canvas having strength of 100 kg for a 5 cm strip. This corresponds to canvases whose weight per square meter is 70 grams or more.

As illustrated in FIGS. 1 and 2, each lifting strap 20 is a one-piece strap and comprises an intermediate section 20*c* adapted to receive a fork of a fork-lift truck. The intermediate section 20*c* forms an oblong loop and is advantageously positioned so as to at least partially extend over the lid 17 of the bag. This specific position permits to improve the stability of the bag when it is raised by the fork-lift truck. Restraining straps 21 positioned over each lifting strap 20 and fixedly connected thereto are provided to maintain the intermediate section 20*c* in said specific position. Furthermore, to prevent that the lifting straps 20, and thus the tubes or ducts 22, substantially project above the lid 17, when the bag is raised by the forks of a fork-lift truck, said restraining straps 21 are disposed so as to limit the extension of the top of the loops formed by the intermediate sections 20*c* in the vertical direction. In particular, the extension of the loops may advantageously be limited to 15 cm in the vertical direction. Thus configured, the bag 10 requires less space when it is raised by a fork-lift truck. Therefore, the bag can be stacked over a fully filled bag even if the free space in the container is reduced.

In FIG. 2, it can be seen a specific arrangement of one lifting strap 20 and of the corresponding restraining strap 21. In this specific arrangement, the lifting strap 20 having a first section 20*a* and a second section 20*b* separated by an intermediate section 20*c* forming an oblong loop and disposed over the lid 17 of the bag, substantially along a horizontal ridge 16 of the bag. The first and the second sections 20*a*, 20*b* are sewn on or along a vertical ridge 15 of the bag. The strap 21 has two vertical sections 21*a*, 21*b* separated by a U-shaped section 21*c*. Each vertical section 21*a*, 21*b* is sewn on one side 11 or 12 of the bag and the U-shaped section 21*c* is positioned over the intermediate section 20*c* of the lifting strap 20 and is at least partially sewn on said intermediate section 20*c*. Thus configured, the restraining strap 21 prevents that the top of the loop formed by the intermediate section 20*c* substantially projects above the lid 17 when the bag 10 is raised by a fork-lift truck.

Figure 1:
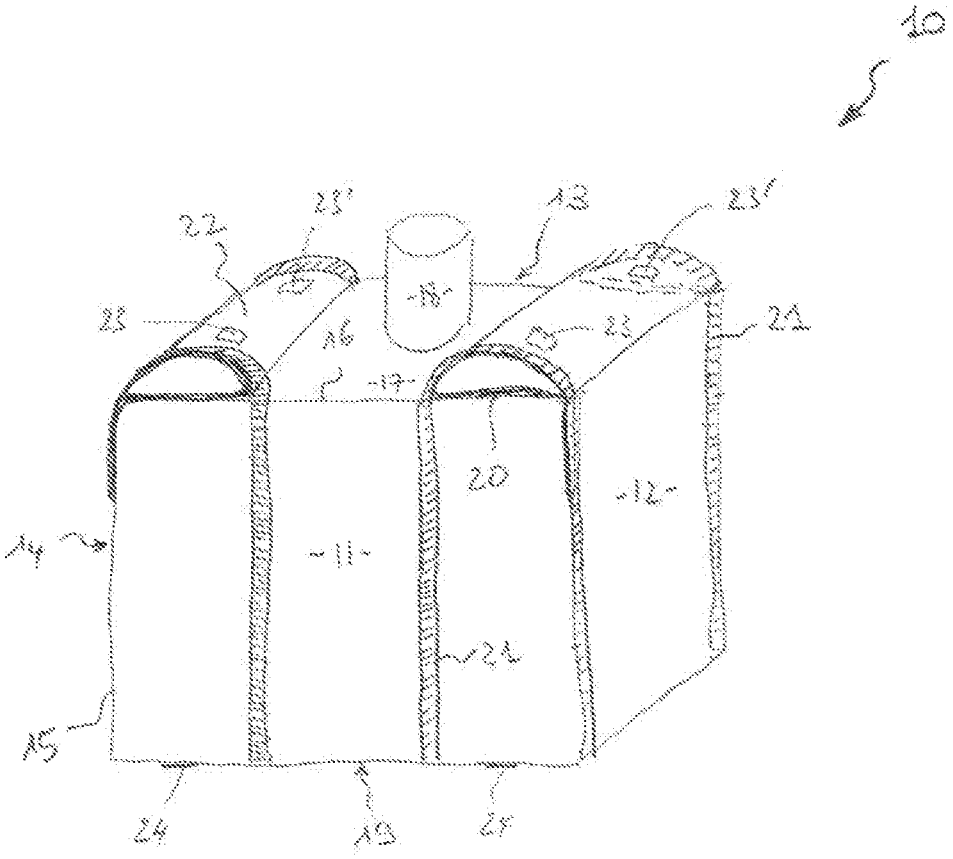
FIG. 1 illustrates in perspective a bag according to a first embodiment of the invention.

As described above, since the tubes or ducts 22 are positioned on the top of the bag and no more on its side, when the bag is raised by the fork lift the bag keeps its cubic shape.

When two bags are stacked one above the other, the tubes 22 are crushed and it may be not easy to introduce the forks of the fork lift in said tubes. To remedy this inconvenience, hook-and-loop means can be fixed on the top of the tubes and under the bottom face of the bag so that the top of the tubes of the lower bag are substantially carried upward when the upper bag is lifted thus rendering easier the introduction of the forks of the fork lift into the tubes.

Said means can consist of pieces 23, 24 of hook-and-loops fasteners such for example as the one known as "velcro". For example said pieces may be square pieces of 10×10 cm, one such piece 23 being fixed respectively on the front part of the tube and one piece 23' being fixed on the rear part of the tube, with corresponding pieces 24 being fixed under the bottom face of the bag.

Figure 2:
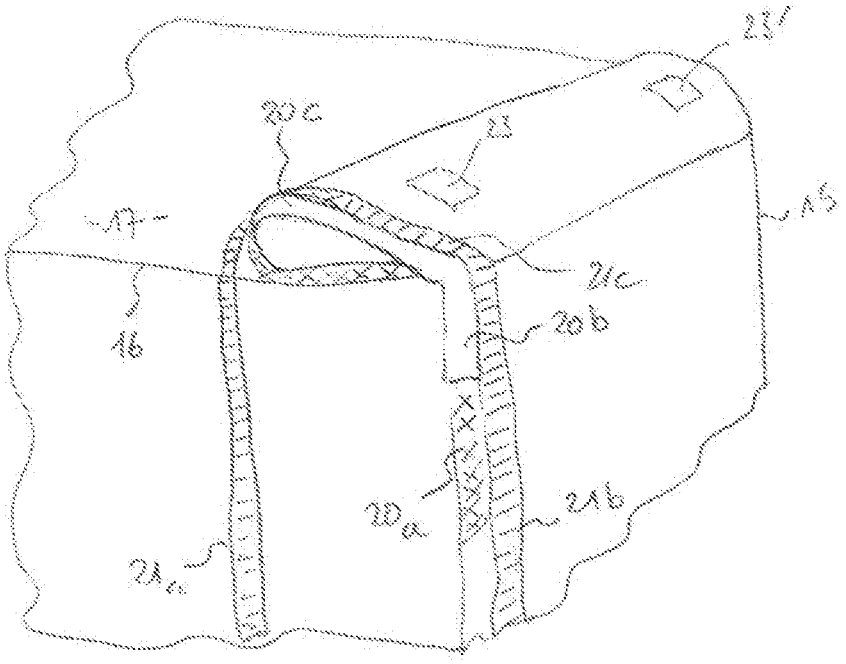
FIG. 2 is an enlarged view of a detail of the bag illustrated in FIG. 1.
Figure 3:
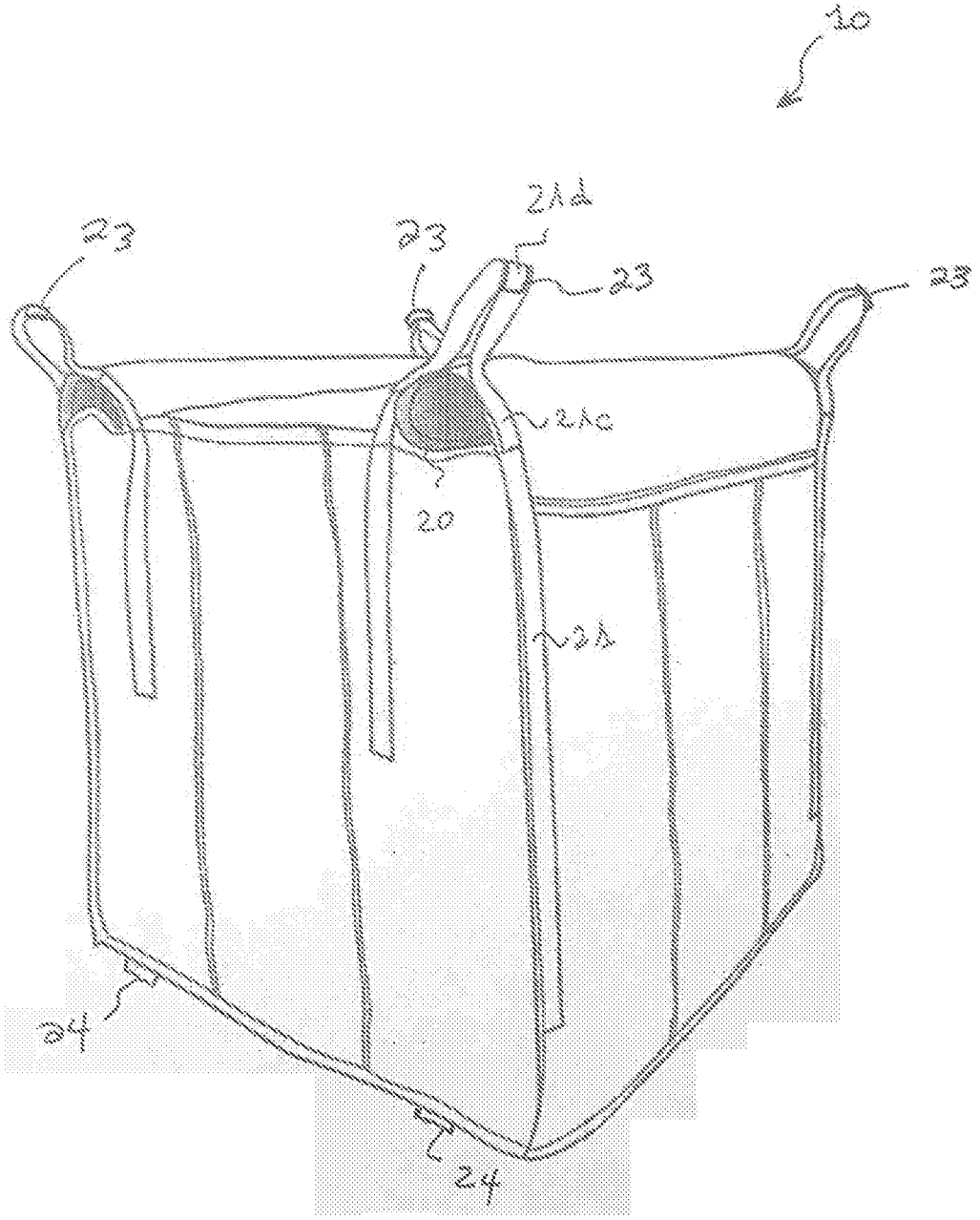
FIG. 3 illustrates in perspective a bag according to a second embodiment of the invention.

FIG. 3 illustrates a bag according to a second embodiment of the present invention. The bag 10 is substantially identical to the bag illustrated in FIGS. 1 and 2, except that the restraining straps 21 are slightly modified. Indeed, in this embodiment, the U-shaped section 21*c* of each restraining strap 21 comprises at least one free portion 21*d* that is not sewn on the corresponding lifting strap 20, said free portion 21*d* forming a loop that may be used as an additional lifting strap. Thus, a fork of a forklift may advantageously be introduced in said additional lifting straps 21*d* to lift the bag during a filling operation.

The invention claimed is:

1. Bag for the transport and storage of bulk goods comprising at least a bottom and four sides, wherein the four sides are connected along adjacent edges to form vertical ridges at each of the four corners of the bag, an upper edge of each of said four sides of the bag forming a horizontal ridge;

wherein the bag further comprises four lifting straps, each lifting strap having a first section and a second section separated by an intermediate section;

wherein the first and the second sections of each lifting strap are sewn on a corresponding one of said vertical ridges of the bag;

wherein the intermediate section of each lifting strap forms an oblong loop and is positioned lengthwise along the horizontal ridge of the bag;

wherein the bag further comprises four restraining straps, each restraining strap having two non-overlapping vertical sections separated by a U-shaped section, each vertical section being sewn on one of said sides of the bag and the U-shaped section being positioned over the intermediate section of a corresponding one of said lifting straps and being at least partially sewn thereon; and wherein the restraining straps are configured so as to limit the extension of the top of the oblong loops formed by the intermediate sections of the lifting straps in the vertical direction.

2. Bag according to claim 1, wherein the restraining straps are configured so as to prevent that the top of the oblong loops formed by the intermediate sections of the lifting straps to project more than 15 cm above a top head of the bag.

3. Bag according to claim 1, wherein the lifting straps are interconnected in pairs by link means forming respective tubes or ducts, the link means being constituted by pieces of fabric stitched onto the lifting straps and matching the outlines of the lifting straps over at least a portion thereof.

4. Bag according to claim 3, wherein the pieces of fabric constituting the linking means are chosen to be a fabric whose weight per square meter is greater than 70 grams.

5. Bag according to claim 1, wherein each side of the bag is connected to a lid along the horizontal ridge, and wherein the intermediate section of the lifting straps is positioned so as to at least partially extend over the lid.

6. Bag according to claim 1, wherein the U-shaped section of the restraining straps comprises at least one free portion that is not sewn on a corresponding lifting strap, said free portion forming a loop and defining an additional lifting strap that may be used to lift the bag during a filling operation.

7. Bag for the transport and storage of bulk goods comprising at least a bottom and four sides, wherein the four sides are connected along adjacent edges to form vertical ridges at each of the four corners of the bag, an upper edge of each of said four sides of the bag forming a horizontal ridge;

wherein the bag further comprises four lifting straps, each lifting strap having a first section and a second section separated by an intermediate section;

wherein the first and the second sections of each lifting strap are sewn on a corresponding one of said vertical ridges of the bag;

wherein the intermediate section of each lifting strap forms an oblong loop and is positioned along the horizontal ridge of the bag;

wherein the bag further comprises four restraining straps, each restraining strap having two vertical sections separated by a U-shaped section, each vertical section being sewn on one of said sides of the bag and the U-shaped section being positioned over the intermediate section of a corresponding one of said lifting straps and being at least partially sewn thereon;

wherein the restraining straps are configured so as to limit the extension of the top of the oblong loops formed by the intermediate sections of the lifting straps in the vertical direction; and wherein corresponding hook-and-loop means are fixed respectively on the top of the U-shaped section of the restraining straps and under the bottom of the bag.

8. Bag for the transport and storage of bulk goods comprising at least a bottom and four sides, wherein the four sides are connected along adjacent edges to form vertical ridges at each of the four corners of the bag, an upper edge of each of said four sides of the bag forming a horizontal ridge;

wherein the bag further comprises four lifting straps, each lifting strap having a first section and a second section separated by an intermediate section;

wherein the first and the second sections of each lifting strap are sewn on a corresponding one of said vertical ridges of the bag;

wherein the intermediate section of each lifting strap forms an oblong loop and is positioned along the horizontal ridge of the bag;

wherein the bag further comprises four restraining straps, each restraining strap having two vertical sections separated by a U-shaped section, each vertical section being sewn on one of said sides of the bag and the U-shaped section being positioned over the intermediate section of a corresponding one of said lifting straps and being at least partially sewn thereon;

wherein the restraining straps are configured so as to limit the extension of the top of the oblong loops formed by the intermediate sections of the lifting straps in the vertical direction;

wherein the lifting straps are interconnected in pairs by link means forming respective tubes or ducts, the link means being constituted by pieces of fabric stitched onto the lifting straps and matching the outlines of the lifting straps over at least a portion thereof; and wherein corresponding hook-and-loop means are fixed respectively on the top part of the tubes or ducts and under the bottom of the bag.

* * * * *